US009969518B2

(12) United States Patent
Kavchok

(10) Patent No.: US 9,969,518 B2
(45) Date of Patent: May 15, 2018

(54) SEMI-AUTOMATIC SYRINGE LABEL APPLICATOR

(71) Applicant: Medical Packaging Inc., Ringoes, NJ (US)

(72) Inventor: Ronald C. Kavchok, Ringoes, NJ (US)

(73) Assignee: MEDICAL PACKAGING INC., Ringoes, NJ (US)

( * ) Notice: Subject to any disclaimer, the term of this patent is extended or adjusted under 35 U.S.C. 154(b) by 368 days.

(21) Appl. No.: 14/750,610

(22) Filed: Jun. 25, 2015

(65) Prior Publication Data

US 2018/0002054 A1 Jan. 4, 2018

Related U.S. Application Data

(60) Provisional application No. 62/046,494, filed on Sep. 25, 2014.

(51) Int. Cl.

| | |
|---|---|
| ***B65C 3/10*** | (2006.01) |
| ***B65C 9/00*** | (2006.01) |
| ***B65C 9/08*** | (2006.01) |
| ***B65C 9/46*** | (2006.01) |

(52) U.S. Cl.

CPC ..... *B65C 3/10* (2013.01); *B65C 9/0006* (2013.01); *B65C 9/08* (2013.01); *B65C 9/46* (2013.01); *B65C 2009/0096* (2013.01)

(58) Field of Classification Search

CPC ..... B65C 3/10; B65C 9/0006; B65C 9/46
USPC ..... 156/362–364, 446–449, 541, 542
See application file for complete search history.

(56) References Cited

U.S. PATENT DOCUMENTS

| | | | | |
|---|---|---|---|---|
| 3,446,690 | A * | 5/1969 | Charles | B65C 3/12 156/215 |
| 3,653,176 | A * | 4/1972 | Gess | B65B 43/50 156/384 |
| 3,783,077 | A * | 1/1974 | Messmer | B65C 3/16 156/364 |
| 3,835,897 | A * | 9/1974 | Gess | B65B 3/12 141/165 |
| 3,990,316 | A | 11/1976 | Risi | |
| 4,447,280 | A | 5/1984 | Malthouse | |
| 4,566,933 | A | 1/1986 | Crankshaw et al. | |
| 5,021,116 | A | 6/1991 | Milgram, Jr. et al. | |
| 5,697,489 | A | 12/1997 | Deonarine et al. | |
| 5,798,020 | A * | 8/1998 | Coughlin | B65C 3/16 156/184 |
| 6,206,590 | B1 | 3/2001 | Thomas et al. | |
| 6,321,812 | B1 | 11/2001 | Kral | |
| RE37,829 | E | 9/2002 | Charhut et al. | |
| 7,261,235 | B2 | 8/2007 | Barenburg et al. | |
| 7,430,838 | B2 | 10/2008 | Rice et al. | |

(Continued)

*Primary Examiner* — Jeffry H Aftergut
(74) *Attorney, Agent, or Firm* — Myers Wolin, LLC

(57) ABSTRACT

A label applicator for applying a label to a cylindrical portion of an object may comprise a roller and a label handler, with the roller rotating the object to which the label is being applied and the label handler separating a label from its backer and extending the label towards the object being rotated by the roller. The distance between the label handler and the object rotated by the roller is less than a length of the label. The label applicator may further comprise a printer, such as a thermal transfer printer, which may be configured to print labels for a plurality of objects to which different labels are applied consecutively.

14 Claims, 9 Drawing Sheets

(56) References Cited

U.S. PATENT DOCUMENTS

| | | | | |
|---|---|---|---|---|
| 7,668,618 | B2 | 2/2010 | Szesko et al. | |
| 7,708,042 | B2 | 5/2010 | McCarthy et al. | |
| 7,722,083 | B2 | 5/2010 | McCarthy et al. | |
| 7,779,988 | B2 | 8/2010 | Clarke et al. | |
| 7,802,671 | B2 | 9/2010 | Clarke et al. | |
| 8,025,085 | B2 | 9/2011 | Skaggs et al. | |
| 8,072,635 | B2 | 12/2011 | Roberts et al. | |
| 8,136,332 | B2 | 3/2012 | Rice et al. | |
| 8,180,653 | B2 | 5/2012 | Banfield et al. | |
| 8,231,749 | B2 | 7/2012 | Dent et al. | |
| 8,851,136 | B1 * | 10/2014 | Drynkin | B65C 9/46 156/387 |
| 2004/0088951 | A1 | 5/2004 | Baldwin et al. | |
| 2006/0037709 | A1 * | 2/2006 | Itoh | B65C 9/32 156/446 |

* cited by examiner

SEMI-AUTOMATIC SYRINGE LABEL APPLICATOR

CROSS-REFERENCE TO RELATED APPLICATION

This application claims the benefit of U.S. Provisional Patent Application No. 62/046,494, filed Sep. 5, 2014, the contents of which are incorporated by reference herein in their entirety.

FIELD OF THE INVENTION

A syringe labeling device that prints and wraps a label around a syringe or other cylindrical object.

BACKGROUND

Typically, labels are applied to syringes manually. This chore is tedious and time consuming. The task of manually printing and applying individualized labels to a large number of syringes is, accordingly, a major source of inefficiency in various settings, such as pharmacies and hospitals.

In addition to such inefficiencies, applying labels by hand may lead to inconsistencies and mistakes. Further, there are a variety of styles in which labels are applied to syringes, including, for example, flagging styles.

Accordingly, there is a need for a system and device to consistently and flexibly automate the label application process. There is a further need for such a system and device that facilitates the application of printed labels onto syringes as would typically be required by a pharmacist in a hospital pharmacy who must prepare syringes with medication for delivery to nurses and physicians to intravenously inject medication into various patients.

SUMMARY

The syringe label applicator is a device that prints and wraps a label around a syringe or other cylindrical object or portion of an object. It is a semi-automatic system that allows a user to place the objects to be labeled into a labeling zone of the labeling device. When the presence of the object is detected by an optical sensor the label applicator begins the application process. A single drive motor rotates and pivots a drive arm having a roller forward, pressing the object against the base and a brace within the labeling zone. Once this forward motion has stopped, a slip clutch starts slipping and the drive arm assembly motor continues to spin, transferring the force of the motor from the drive arm to the roller by the use of pulleys. The belt on the pulley is configured to rotate the roller in a reverse direction which corrects the direction of the spinning object. The label printing then begins as the drive roller is spinning. As the label ejects from the printer it passes under a stripper bar acting as a label handler and is removed from the backer. The label is then passed between the object and base causing the label to stick to and wrap around the object. After the printing sequence is completed, and the label applicator is done rotating, the motor reverses direction causing the arm to return to the home position. The user may then remove the object from the labeling zone.

Accordingly, a label applicator for applying a label to a cylindrical portion of an object may comprise a roller and a label handler, with the roller rotating the object to which the label is being applied and the label handler separating a label from its backer and extending the label towards the object being rotated by the roller. The distance between the label handler and the object rotated by the roller in the labeling zone may be less than a length of the label. The label applicator may further comprise a printer, such as a thermal transfer printer, which may be configured to print labels for a plurality of objects to which different labels are applied consecutively. In some embodiments, the printed label may be determined by a detected feature of the object or the cylindrical portion of the object, such as a diameter.

The roller may be mounted on a motorized arm, and the roller may be moved into contact with the cylindrical portion of the object on the motorized arm after the object is placed in the labeling zone and is detected by a sensor. When the roller contacts the object, the object may be braced between the roller, the base of a platform, and an associated bracing element.

In some embodiments, a single motor may control both the motion of the motorized arm and the rotation of the roller using a slip clutch.

In some embodiments, the label handler is a stripper, and the label is stripped from a label backer by forcing the label backer around a sharp turn so that the label separates from the backer.

The label may have different configurations and may have different segments with different adhesives applied thereto, allowing for a variety of label applications.

DETAILED DESCRIPTION OF THE PREFERRED EMBODIMENTS

Figure 1:
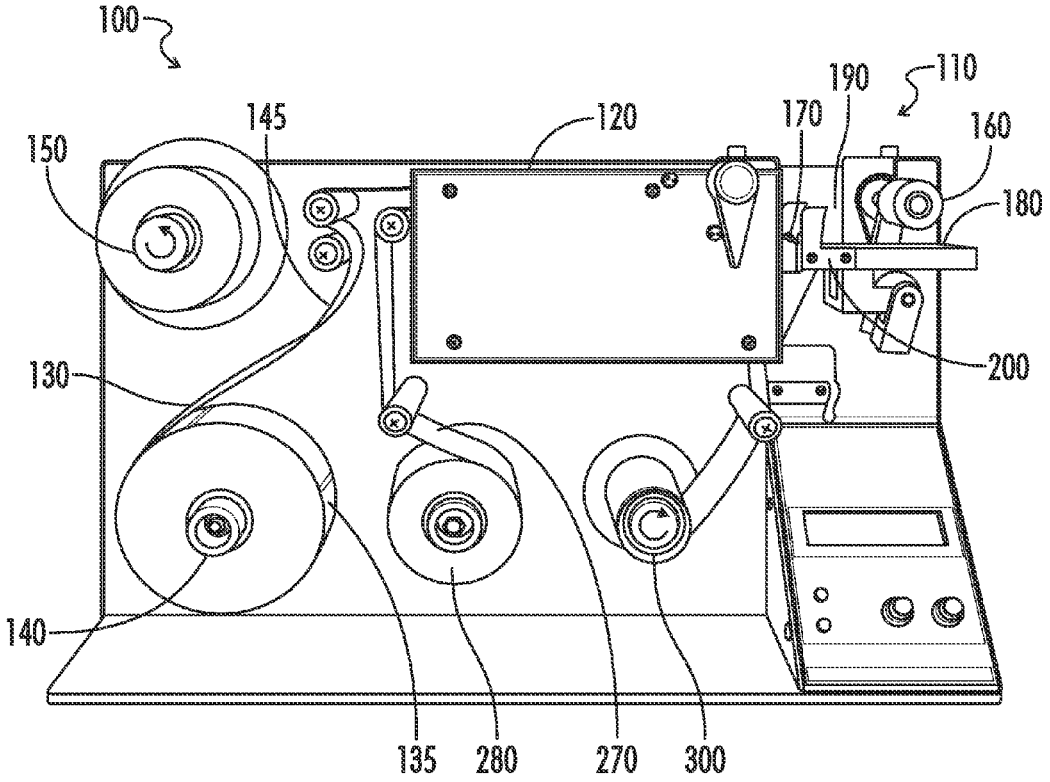
FIG. 1 shows a front image of a syringe label applicator.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached,"

"affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 2A:
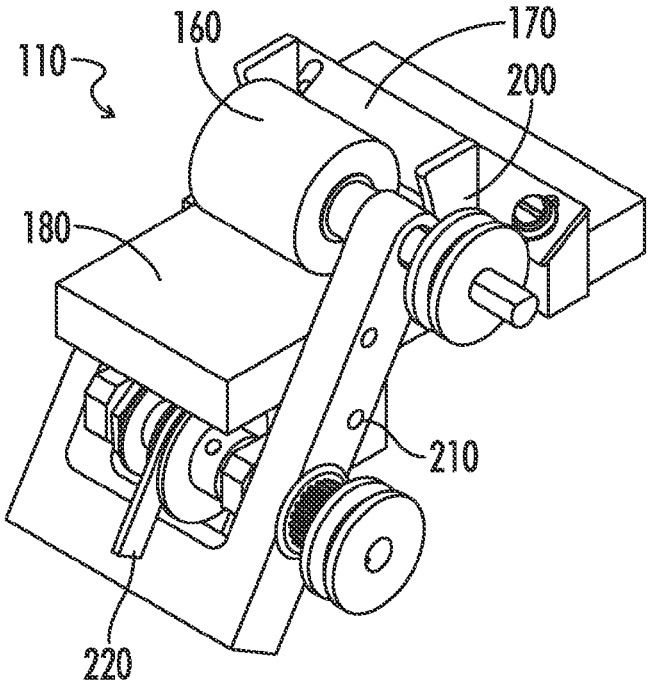
FIG. 2A shows a perspective view of a roller and drive arm assembly for a syringe label applicator.
Figure 2B:
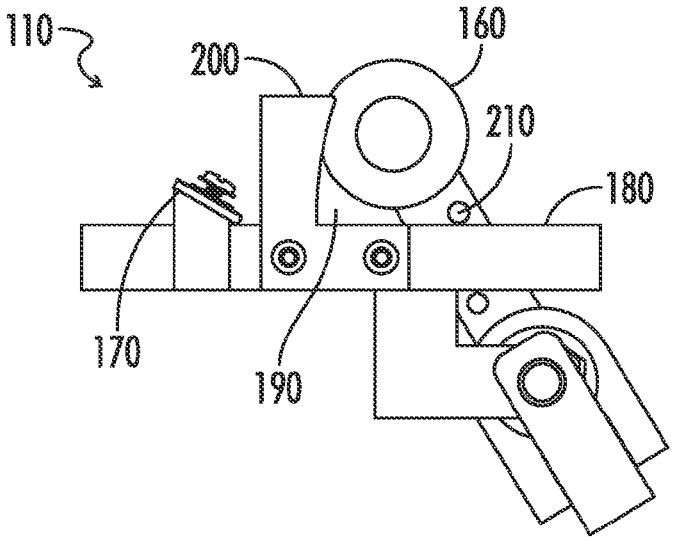
FIG. 2B shows a front view of the roller and drive arm assembly of FIG. 2A.
Figure 3:
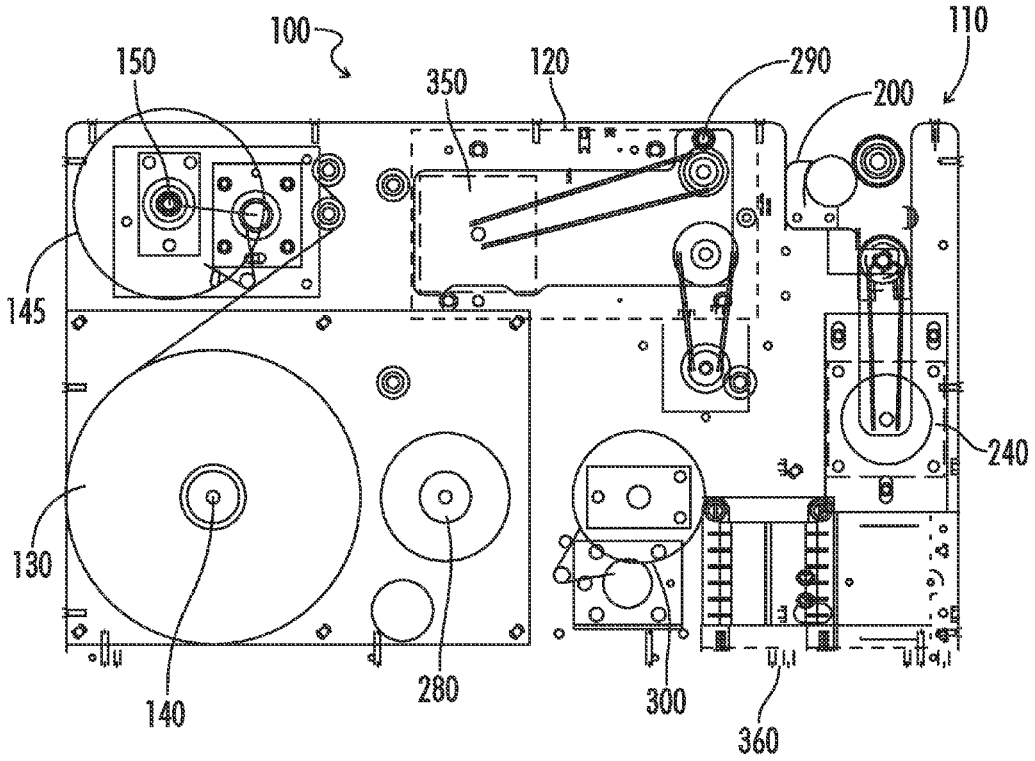
FIG. 3 shows a schematic view of the applicator of FIG. 1.

FIG. 1 shows a syringe label applicator 100 and FIGS. 2A-2B show detail views of a roller and drive arm assembly 110 for the syringe label applicator 100. FIG. 3 shows a schematic view of the applicator shown in FIG. 1. The syringe label applicator 100 typically comprises the roller and drive arm assembly 110, occasionally referred to as a labeling station, a printer assembly 120, label stock 130 mounted on a label stock roller 140, and a label stock take up reel 150. Roller and drive arm assembly 110 comprises a roller 160 for rotating an object to be wrapped, such as a syringe, and a label handler 170 for positioning a label 135 from the label stock 130 for application to the object.

Labels 135 of the label stock 130 are typically provided spaced apart on a label backer 145 provided in the form of an elongated strip. The roller 160 and the label handler 170 are positioned within the assembly 110 such that a label 135 removed from a label backer 145 of the label stock 130 by the label handler 170 and extending from the label handler contacts the object rotated by the roller. Further, once removed from the label backer 145, the label will have exposed adhesive facing the object, and as the object is rotated by the roller 160, the adhesive backing of the label 135 sticks to and is picked up by the rotating object and wraps around the object.

The label 135, with its exposed adhesive facing upwards, for example, may be passed between the object and a base 180 of the roller and drive arm assembly 110, and the object may be located in a labeling zone 190 on the base 180. The labeling zone 190 may be demarcated by a brace 200. After the object enters the labeling zone 190, the roller is then placed in contact with the object, securing it in the labeling zone 190 between brace 200 and roller 160. The label 135 is then pressed against the object rotating on base 180 within the labeling zone 190 and the adhesive sticks to the object. Accordingly, the roller and drive arm assembly 110 wraps a label around a cylindrical portion of the object.

Typically, the object is substantially cylindrical, but the syringe label applicator 100 may also apply labels 135 to cylindrical portions of larger objects, such as a syringe with elongated flanges. In such embodiments, the base 180 may be narrow enough such that the cylindrical portion of the syringe rests on the base and the flanges are suspended on either side of the base.

Typically, the system is operated by a user, and the user places the object to be labeled into the labeling zone 190 between roller 160, base 180, and brace 200. When the presence of the object is indicated or detected, the label applicator begins an application sequence. The indication may be by having the user press a button or may be by using a sensor, such as an optical sensor to sense the presence of the object, for example. A drive arm assembly motor 240 rotates and pivots a drive arm 210 carrying roller 160, pressing the object against base 180 and brace 200 within labeling zone 190. Once the object is positioned against brace 200, the resistance of the object causes the forward motion of the drive arm 210 to stop, releasing a slip clutch 220 and transmitting the rotational force from the drive arm assembly motor 240 to the roller 160 instead of the drive arm 210. Accordingly, a single drive arm assembly motor 240 may both move the drive arm 210 and rotate the roller 160 consecutively.

The printer assembly 120 of the applicator is for printing the labels 135 of the label stock 130 prior to the application of the label to the objects at the roller and drive arm assembly 110. The printer assembly may be, for example, a thermal transfer printer for the label stock 130 to pass through. Accordingly, each label 135 may be passed through the printer assembly 120. The label is then removed from label backer 145 at label handler 170, in this case a stripper bar, and applied to a the object, while the label backer continues to a label backing take-up reel 150. Label stock 130 continuously passes through the printer assembly 120 as new objects to be labeled are placed in the labeling zone 190, and printer ink ribbon 270 is taken from a ribbon stock roller 280, and passes through the printer assembly 120, where ink is applied to the label stock 130 using, for example, a pressure roller 290. Used printer ribbon 270 continues to the ribbon take-up reel 300.

Within the printer assembly, stepper motors are used to rotate spools as required to imprint desired information onto each label, whereby successive labels 135 are typically imprinted with different information for labeling associated objects.

While an object, such as a syringe, is rolled by the roller 160 in the labeling zone 190, a label 135 is passed through the printer assembly 120, removed from the label backer 145 by the label handler 170, and applied to the object. As shown, where the label handler 170 is a stripper bar, the label 135 may be removed from the label backer 145 by bending the label backer around the label handler 170 such that the label separates from the label backer. The label 135 may separate from the backer 145 due to the label having a higher stiffness than the backer, or it may separate because the backer is tensioned by the backer take-up reel 150, while the label is not so tensioned.

While a specific configuration of label stock 130, ink ribbon stock 280, and printer assembly 120 are shown and described, it will be understood that alternate printing systems are contemplated and may be used in conjunction with the label applicator.

The syringe label applicator 100 may further include sensors for determining if printer ribbon 270, or thermal transfer ribbon, is present. Similarly, the device may further include sensors for determining the position of the label stock 130 based on, for example, index marks, and to confirm the presence of label stock, for evaluating the head position of a print head in the printer assembly 120, and to determine whether an object has been placed in the labeling zone 190. Several readily available sensors, such as photoelectric sensors, may be appropriate for detecting the presence of the object to be labeled. The device may further include a sensor for detecting the position of a pressure roller knob and the label backer take-up 150.

Figure 4:
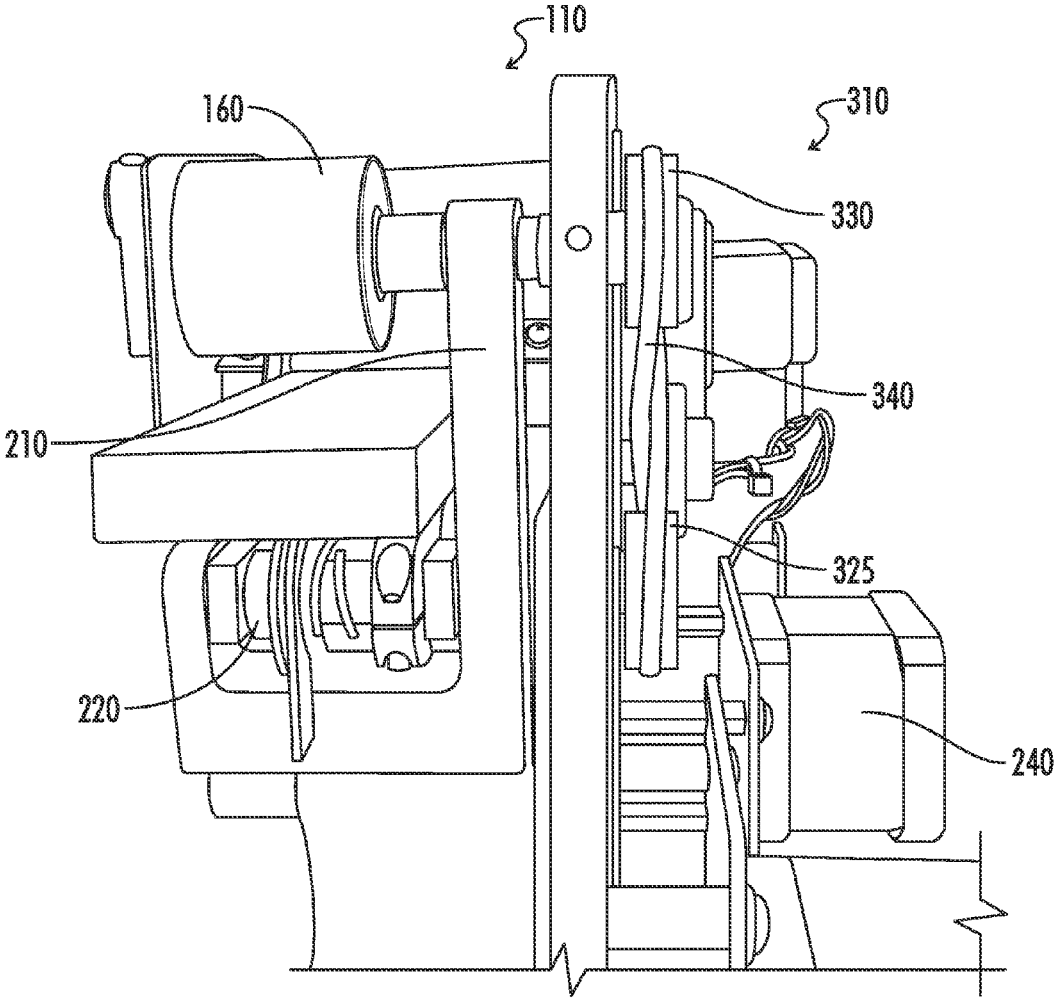
FIG. 4 shows a side view of the roller and drive assembly of the applicator of FIG. 1.
Figure 5:
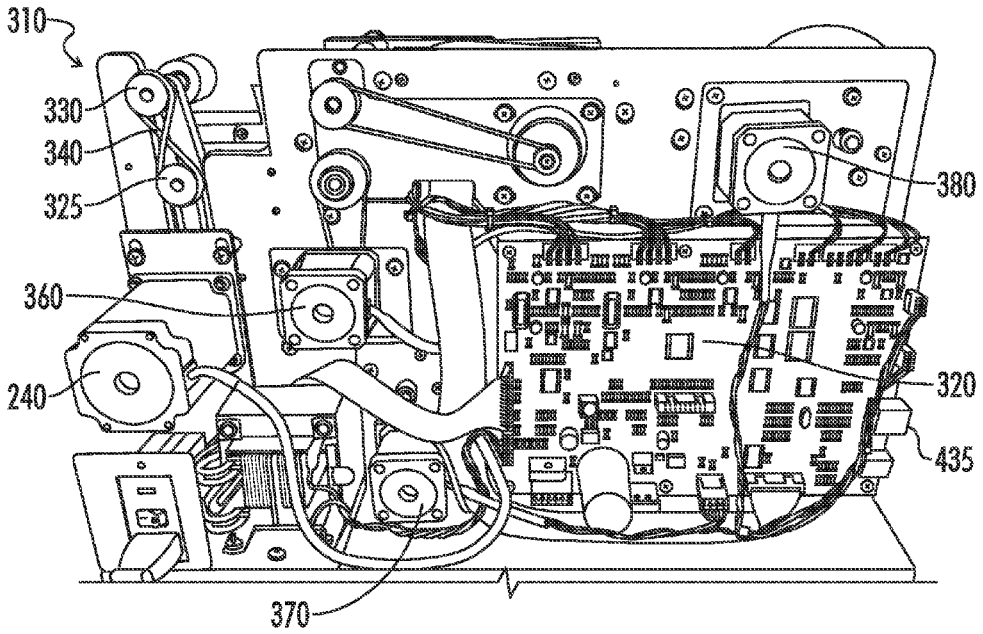
FIG. 5 shows a back view of the applicator of FIG. 1.

FIG. 4 shows a side view of the roller and drive assembly 110, including a view of the slip clutch 220, and FIG. 5 shows a back view of the syringe label applicator 100, including views of a variety of motors driving various components of the applicator and printer assembly 120, as well as circuitry. As shown, the drive arm assembly motor 240 controls both the movement of drive arm 210 and the rotation of roller 160 by way of slip clutch 220. When an object is placed in the labeling zone 190, drive arm assembly motor 240 begins rotating, moving drive arm 210 into position, thereby bringing roller 160 into contact with the object. When the forward motion of drive arm 210 is impeded by the object, such as when the object is braced against brace 200 within the labeling zone 190, the slip clutch 220 begins to slip, thereby transferring the force of drive arm assembly motor 240 to roller 160, which begins to rotate. The surface of roller 160, in contact with a cylindrical segment of the object, begins to rotate the object.

When the slip clutch 220 begins to slip, the force of the rotation is transferred to a pulley system 310 including two wheels 325, 330, and a belt 340. Belt 340 changes the direction of motion of the second wheel 330 such that roller 160 rotates in the opposite direction of the rotation of the drive arm 210 about its axis. Accordingly, in the embodiment shown, the transmission of rotation to the object results in counter-clockwise rotation of the object within the labeling zone 190 when the applicator 100 is viewed from the front.

Typically, when the drive arm assembly motor 240 begins rotating, the printer assembly 120, as well as the backer take-up reel 150 and the ribbon take-up reel 300 are activated as well.

After the printing sequence is completed and the roller 160 is done rotating, the drive arm assembly motor 240 reverses direction, with the slip clutch 220 transmitting the force of the motor to the drive arm 150, thereby causing the arm to return to the home position. The user then removes the object from the labeling zone 190.

The applicator 100 further includes a controller provided on a printed circuit board 320. The controller includes a microprocessor and memory for storing information to be printed on successive labels 135. Further, as described below, a number of modes may be preprogrammed into typical embodiments of the applicator 100, and different printing and labeling sequences may be implemented. It will be understood that while the embodiment shown includes a controller on a printed circuit board, many different types of controllers are contemplated, including controllers external to the syringe label applicator 100 entirely, such that different components of the syringe label applicator, such as the printer assembly 120 and the roller and drive arm assembly 110 may be controlled directly and independently. Similarly, the hardware components may be configured to interface with external software and may be controlled through standardized connections therewith.

The syringe label applicator 100 of the embodiment shown includes five motor drives capable of performing full and micro stepping modes of operation, each controlled by the controller on the circuit board 320. Each motor drive is enabled under software control. In some embodiments, the enable signal shuts down output transistors and allows the same driver software to control up to four motors simultaneously.

In the embodiment shown, the five drive motors include (1) the drive arm assembly motor 240, which controls the label applicator and has already been discussed in detail, (2) the platen drive motor 350, shown in FIG. 3, which drives the platen and pressure roller 290 within the printer assembly 120, (3) the head position motor 360 which raises and lowers the print head of the printer assembly 120, (4) the ribbon take-up motor 370, which collects used printer ribbon 270 passing through the printer assembly 120 and (5) the label backer take-up motor 380 which drives the label backer take-up reel 150.

Accordingly, the printer ribbon 270 and the elongated strip of label backer 145 are both tensioned in the syringe label applicator 100 by the motors 370, 380 at their respective take-up reels 300, 150.

Many of the motors are typically operated simultaneously and may therefore work in concert. The platen drive motor 350, the drive arm assembly motor 240 and the two take-up motors 370, 380, may all be driven simultaneously in order to apply a label to an object. Other motor types and configurations may be implemented as well to, for example, reduce the number of motors or to render the label application process more efficient.

Figure 6:
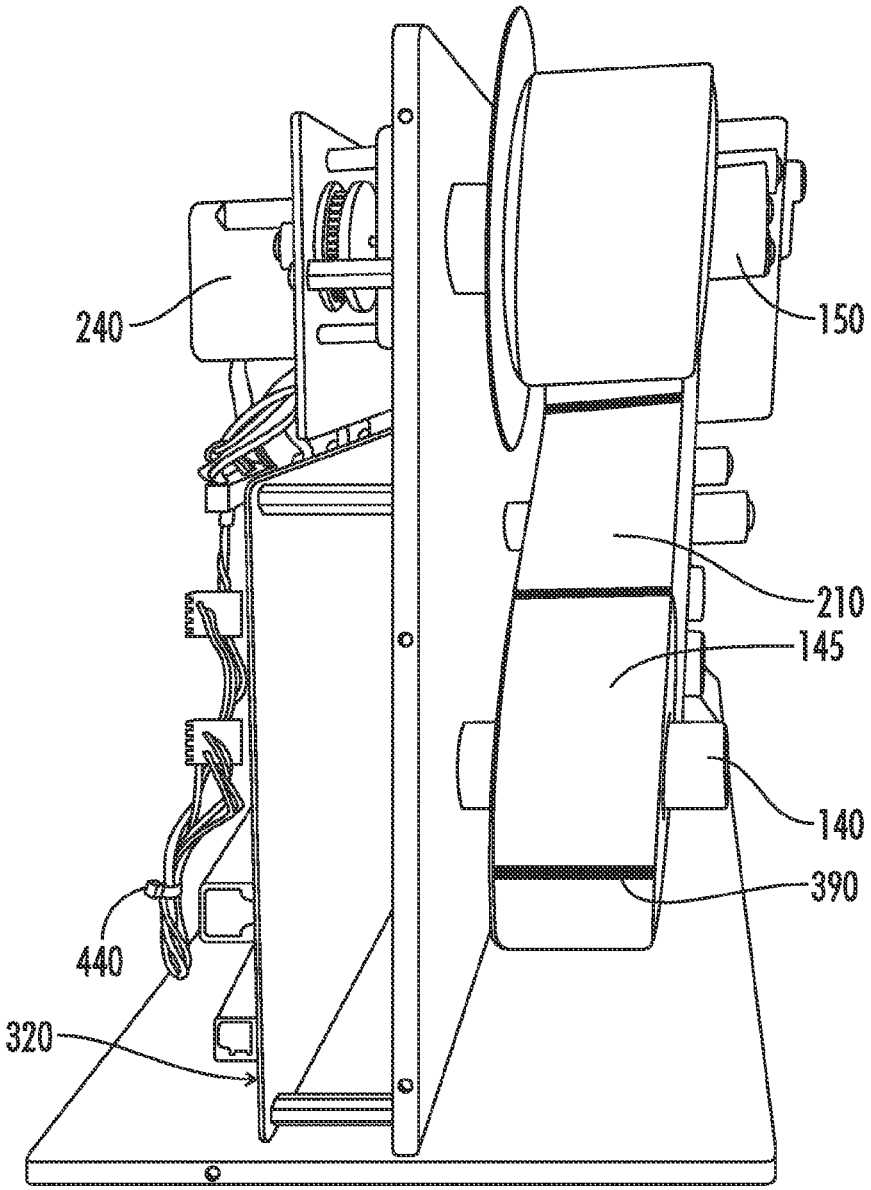
FIG. 6 shows a side view of the applicator of FIG. 1.

FIG. 6 shows a side view of the syringe label applicator 100 of FIG. 1, including views of label stock roller 140 and label backing take up reel 150. As shown, labels 135 are typically provided on a label backer 145 and the take up reel 150 collects the label backer after labels are removed from the backing. In some embodiments, the label backer 145 contains index marks 390 for use by sensors to locate the labels for printing and application.

Figure 7:
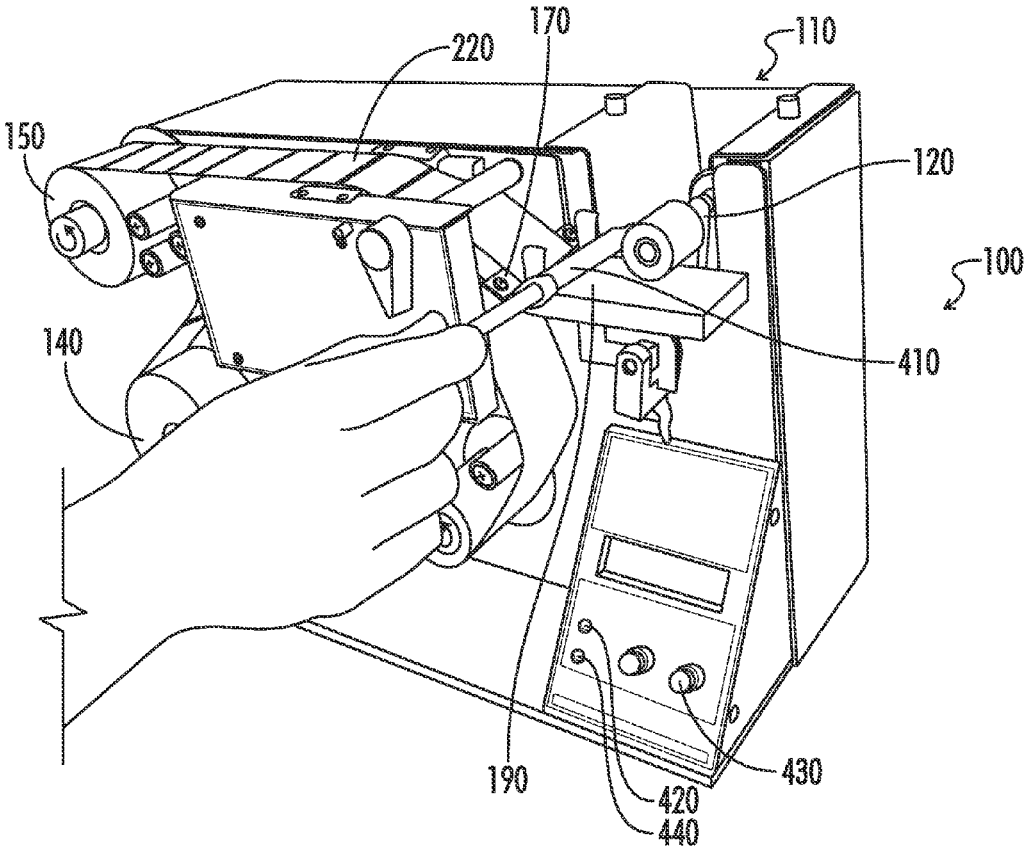
FIG. 7 shows a front view of the applicator of FIG. 1 with a syringe in the application area.

FIG. 7 shows a front view of the syringe label applicator 100 with a syringe 410 in the labeling zone 190. When the syringe 410 is detected by a sensor, the roller 160 moves into contact, pressing the syringe between the base 180 and the brace 200, and begins to rotate the syringe. Simultaneously, the printer assembly 120 begins to print on a label 135 on label backer 145 as it gets pulled through the printer assembly 120 by the label backing take up reel 150. In some embodiments, no sensor is provided or the sensor may be deactivated. In such embodiments, the sequence may be started by placing the syringe 410 in the labeling zone 190 and pushing the "print" button 430 to begin the sequence.

The Syringe Label Applicator 100 may print in either batch or demand modes. Batch mode will repeat the same label 135 each time a syringe 410 is placed in the labeling zone 190 until the mode is cancelled by a user. Demand mode, instead, maintains communication with a host computer or some alternate input method, printing a new label 135 for each syringe 410 placed in the labeling zone 190. Such a mode may be for label serialization or for patient specific labelling. While these two modes are described, other modes are contemplated, and the device may be user programmable for other modes as well.

Typically, the length of time for the sequence is controlled by a wrap time setting maintained within a memory of the syringe label applicator. The wrap time may be set based on the length of a label 135 or the size of a syringe 410 to be labeled. Alternatively, a sensor may be provided to detect the completion of the wrapping process, or the wrapping may be limited based on the rotation of the object or some other criteria. Similarly, a delay between cycles may be applied to prevent the system from beginning a new application sequence before each element of the system is ready. The system may include a "ready" light 420 which changes color to indicate that it is ready for a new cycle.

Typically, the system uses first-out label printing where the label 135 that is being printed is the same label that is immediately applied to the syringe 410. In such a scenario, no label queue may be provided. Alternatively, a printer assembly 120 may instead print several labels and control which label gets applied to which syringe.

In the device shown, the printer assembly 120 may be installed near the label handler 170. In some embodiments, the distance between the printer head in the printer assembly 120 and the label handler 170 may be less than the length of the label 135. Accordingly, the label handler 170 may begin to remove the label 135 from the label backer 145 before the printing sequence is completed. Similarly, the elements of the device may be positioned such that the label 135 begins to wrap around the syringe 410 before the printing sequence is completed.

Figure 8:
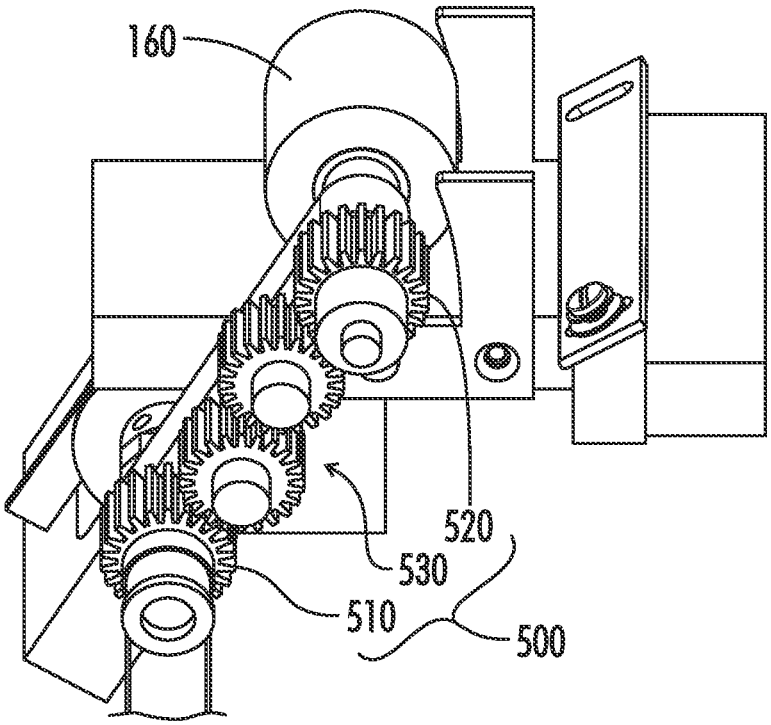
FIG. 8 shows a perspective view of an alternate assembly for rotating the roller.

FIG. 8 shows a perspective view of an alternate assembly 500 for rotating the roller 160. While the roller is described above as rotated by pulley system 310, in alternate embodiments, other mechanisms may be used to transfer the force of rotation from the drive arm assembly motor 240 to the roller 160, such as a gearing assembly 500.

In the gearing assembly 500, when the slip clutch 220 begins to slip, the force of rotation is transferred to a first gear 510, which in turn transfers rotation to a second gear 520. A series of interim gears 530 are arranged between the first gear 510 and the second gear 520 which change the direction of motion of the second gear, such that roller 160 rotates in the opposite direction of the rotation of the drive arm 210 about its axis. While a pulley system 310 and a gearing assembly 500 are shown, alternative implementations are contemplated as well.

The labels 135 may each include a back portion upon which an adhesive is applied prior to being placed on the label backer 220, typically prior to being installed in the syringe label applicator 100. The adhesive may be applied in a variety of manners, such that, for example different portions of the label have different adhesives applied, or such that the adhesive applied to one portion of the label is deadened relative to another portion. For example a first portion may have a semi-permanent adhesive applied such that it sticks to the object while a second portion may have a deadened adhesive or no adhesive applied such that it extends from the object as a flag. Similarly, the first portion may have a permanent adhesive and the second portion may have a semi-permanent adhesive such that the second portion may initially stick to the object, but may be removed from the object and extended as a flag later, during use of the object. These adhesive application techniques may be used to generate labeled syringes consistent with different labeling styles.

Figure 9A:
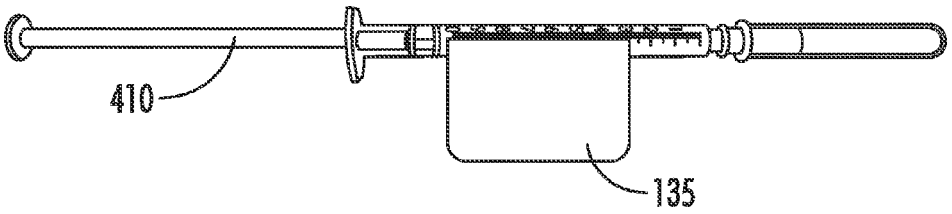
FIGS. 9A-C illustrate three labeling styles in which labels may be applied using the applicator of FIG. 1.

FIG. 9A shows a flagged style, where a clear portion of a label is wrapped around the syringe with semi-permanent adhesive. In such a configuration, a printed portion of the syringe label extends and hangs from the syringe as a flag. The adhesive behind the white area is deadened to prevent it from sticking to the syringe or other objects when the label is applied, so it can be easily propped up and used as a flag, allowing for easy identification of the contents of the syringe.

Figure 9B:
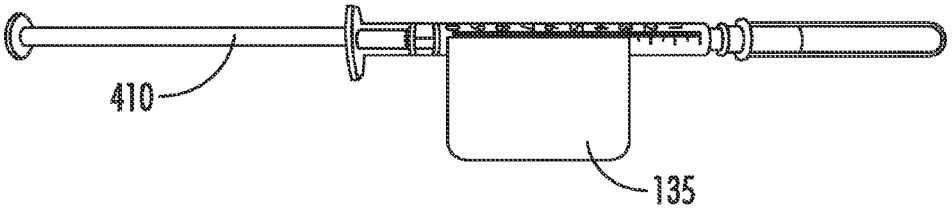

FIG. 9B shows a tacked style, where the clear portion of the label is wrapped around the syringe with a semi-permanent adhesive. In this style, the printed portion has less adhesive causing it to remain fixed to the syringe when applied, but allowing it to be pulled away in order to read the text on the label and see the contents in the syringe. This arrangement allows for easier storage initially, while also allowing for more flexible label viewing options during use of the syringe.

Figure 9C:
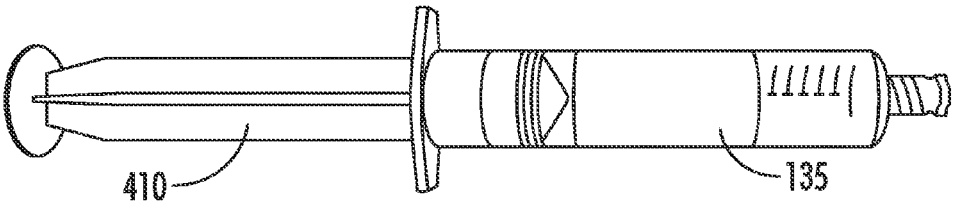

FIG. 9C shows a complete and permanent labeling. In such a configuration, the printed and clear portions of this label are completely wrapped around the syringe, and often, the printed portion overlays the clear portion. The label arrangement is considered permanent, and is used where the need to see behind the label is not as important. Similarly, shorter labels made only of printable portions with permanent adhesive backings may be provided for applying to a syringe in this manner.

Accordingly, the label 135 may be one of a variety of standard label types. Typically, the first 1.5" clear portion of any label remains unprinted and contains an adhesive backing. This portion of the label 135 is wrapped around the syringe 410, while the remaining printed portion of the label may remain extended from the syringe as a flag, for example, as shown in FIGS. 8A-C. In the embodiment shown, the minimum label length is 3" and there is no set maximum label length. Label width would typically be 1.0", 1.5" or 2.0." While these configurations and measurements are used in the embodiment shown, other measurements may be implemented as well to apply labels sized or shaped differently to a variety of syringes 410 or other objects.

In some embodiments, the portion of the label having a permanent adhesive may be transparent and the portion having the semi-permanent or deadened adhesive may be opaque and prepared for printing. For example, the opaque portion may have a matte finish designed for retaining ink.

The syringe label applicator 100 shown is capable of wrapping any cylindrical object with a diameter of 0.25" to 1.25." These measurements encompass syringes raging from 0.5 ml to 60 ml. However, systems configured differently may accommodate larger or smaller cylindrical objects.

The syringe label applicator 100 may have a print only mode where the printer assembly 120 may be used to print a label 210 to be manually removed and applied to an object by hand. In such an embodiment, the system may be activated by pressing the "print" button 430.

The syringe label applicator 100 may operate at 115 or 230 Volts, and the voltage may be determined by a user selectable switch. Alternatively, the device may be adapted for use in other electrical systems.

The syringe label applicator 100 may include a variety of inputs, including the "print" button 430 and a "cancel" button 420 for stopping a sequence. Additional features may be implemented utilizing these buttons, such as a counter reset activated by pushing the "cancel" button 420 twice. Further, commands may be provided using a USB or Ethernet port 435 included in the device, as well as additional input ports.

As shown, a "ready" LED 420 will illuminate in green when the system is ready for the next object. A "status" LED 440 will illuminate in red when a label has been loaded or otherwise not ready. The LEDs 420, 440 may flash to indicate specific conditions as well. In the embodiment shown, information may be output to a provided 16 character LCD display 450 and through LED lights provided. In other embodiments, additional or alternative outputs, such as an output to a computerized interface or more sophisticated integrated displays, may be implemented as well.

Accordingly, the syringe label applicator 100 may interface with a computer using proprietary software. For example, using appropriate interfacing software, the host computer instruct the applicator 100 to (1) load a label 135 into the printer assembly 120, (2) set a demand or batch print mode, (3) set a wrap time, (4) set a cycle delay period, and (5) set a wrap mode as auto or manual.

Once the instructions and/or the label are in memory, the LCD display 450 displays "Label Loaded" and the "ready" LED 420 illuminates. The user may then place a syringe 410 into the device and the operation is automatically initiated by the optical sensor (if in auto mode) or by pressing the "print" button 430 (in manual mode).

Once the process is initiated, the controller raises the print head turns on both take-up motors 370, 380, activates the platen drive motor 350, print head position motor 360, and the drive arm assembly motor 240, and implements the cycle discussed above. When the print cycle is complete the print head will lower, and the ribbon take-up 300 will turn off after a short period of time in order to keep tension on the ribbon. The platen drive motor 350 will continue to run until a sensor provided finds an index mark, at which time the backer take-up motor 370 will turn off. After the wrap time is complete the drive arm assembly motor 240 may turn off as well. The system will then wait the cycle delay time before the "ready" light 220 re-illuminates, indicating the system is ready for the next syringe 410.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A label applicator for applying a label to a cylindrical segment of an object, the applicator comprising:

a roller for rotating the segment of the object;

a label handler, wherein a label extending from the label handler contacts the segment of the object rotated by the roller;

a labeling zone; and a motorized arm for moving the roller into contact with the segment of the object, wherein the roller contacts the segment of the object after the object enters the labeling zone, and wherein a single motor moves the motorized arm and rotates the roller consecutively, such that when the roller contacts the segment, the arm stops moving and the roller begins to rotate.

2. The label applicator of claim 1 further comprising a slip clutch for transmitting power from the single motor to one of the motorized arm and the roller.

3. The label applicator of claim 1 further comprising a bracing element, wherein the segment of the object is secured between the roller and the bracing element, and wherein the label has a length, and wherein the distance between the label handler and the segment of the object is less than the length.

4. The label applicator of claim 1 further comprising a detector for detecting the presence of the object.

5. The label applicator of claim 1 further comprising a printer.

6. The label applicator of claim 5 wherein the label has a length and wherein the distance between a printer head of the printer and the label handler is less than the length.

7. The label applicator of claim 5 wherein the printer is a thermal transfer printer.

8. The label applicator of claim 5 further comprising a processor, wherein the processor transmits printing instructions to the printer for a plurality of objects to which labels are applied consecutively, and wherein the printing instructions for consecutive objects are different.

9. The label applicator of claim 5 wherein the label is printed at the printer and applied to the object, and wherein there is no label queue.

10. The label applicator of claim 1 wherein the label handler is a stripper for removing a label from a backing.

11. The label applicator of claim 10 wherein the backing of the label is bent around the stripper such that the label separates from the backing.

12. The label applicator of claim 11 wherein a label backing take up reel is rotated to pull the backing around the stripper.

13. A label applicator for applying a label to a cylindrical segment of an object, the applicator comprising:

a roller for rotating the segment of the object;

a label handler, wherein a label extending from the label handler contacts the segment of the object rotated by the roller;

a labeling zone;

a printer; and a processor, wherein the processor transmits printing instructions to the printer for a plurality of objects to which labels are applied consecutively, and wherein the printing instructions for consecutive objects are different, wherein the roller contacts the segment of the object after the object enters the labeling zone, and wherein the printing instructions are determined by a detected feature of the object.

14. The label applicator of claim 13 wherein the detected feature is a diameter of the cylindrical segment.

* * * * *